United States Patent [19]

Resnicow

[11] 4,370,824

[45] * Feb. 1, 1983

[54] AERIAL DEVICE

[76] Inventor: Herbert Resnicow, 107 Weeks Rd., East Williston, L.I., N.Y. 11596

[ * ] Notice: The portion of the term of this patent subsequent to Oct. 18, 1996, has been disclaimed.

[21] Appl. No.: 771,279

[22] Filed: Feb. 23, 1977

[51] Int. Cl.[2] ..... A63H 27/00; B64C 3/12

[52] U.S. Cl. ..... 46/74 D; 244/23 C; 244/12.2; 273/424

[58] Field of Search ..... 244/12.2, 23 C, 200; 46/60, 47, 48, 56, 74 D, 74 R, 81, 82, 83, 84, 75; 273/106 R:106 B:106 F; 124/5; 102/31, 37.1, 37.5; D34/15 HH, 15 HS

[56] References Cited

U.S. PATENT DOCUMENTS

| | | | |
|---|---|---|---|
| D. 225,250 | 11/1972 | Sun | D34/15 HS |
| 1,554,065 | 9/1925 | Blair | 46/82 |
| 1,907,815 | 5/1933 | Hough | 46/84 |
| 2,822,176 | 2/1958 | Robes | 273/106 B |
| 3,109,256 | 11/1963 | Dean | 46/74 D |
| 3,508,360 | 4/1970 | Williams | 46/75 |
| 3,605,328 | 9/1971 | Kilroy | 46/83 |
| 3,901,208 | 8/1975 | Laporte et al. | 124/5 |
| 3,935,663 | 2/1976 | Leibowitz | 46/74 D |
| 3,939,648 | 6/1960 | Fleissner | 244/12.2 |
| 3,959,916 | 6/1976 | Meyer | 46/74 D |

FOREIGN PATENT DOCUMENTS

| | | | |
|---|---|---|---|
| 1406529 | 3/1969 | Fed. Rep. of Germany | 244/12.2 |
| 393086 | 12/1908 | France | 244/200 |
| 163645 | 6/1958 | Sweden | 124/5 |
| 5415 | of 1896 | United Kingdom | 124/5 |
| 353090 | 7/1931 | United Kingdom | 102/37.5 |

OTHER PUBLICATIONS

Ingold, "Fella Has a Flying Saucer—," *Washington Times Herald,* Monday, Jan. 11, 1954.

*Primary Examiner*—Galen L. Barefoot

[57] ABSTRACT

An aerial device in the form of a disc which can be "sailed" in the air by throwing it in a manner to impart rotation to the disc. Vanes, holes and/or conduits are provided in the disc to force air from the top side or perimeter or other location to the underside thereof. By such means, increased lift is imparted to the device. Also, air cavities are provided to collect and maintain the air on the underside to provide an air cushion, further enhancing the lift imparted to the device.

1 Claim, 24 Drawing Figures

Fig. 16
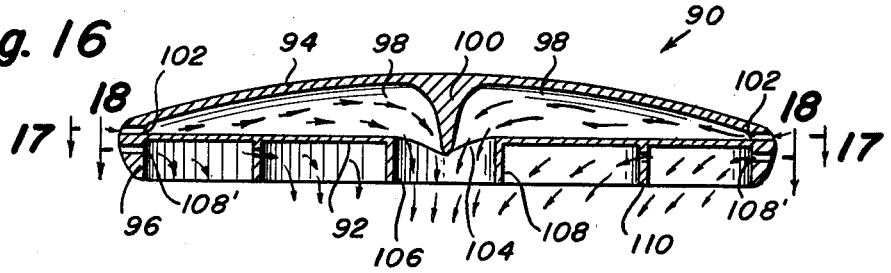
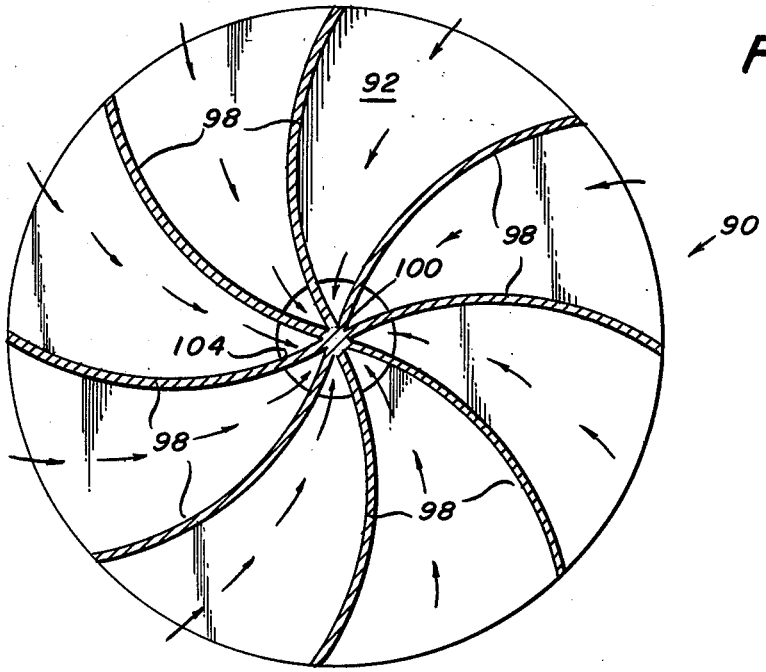
Fig. 17
Fig. 18
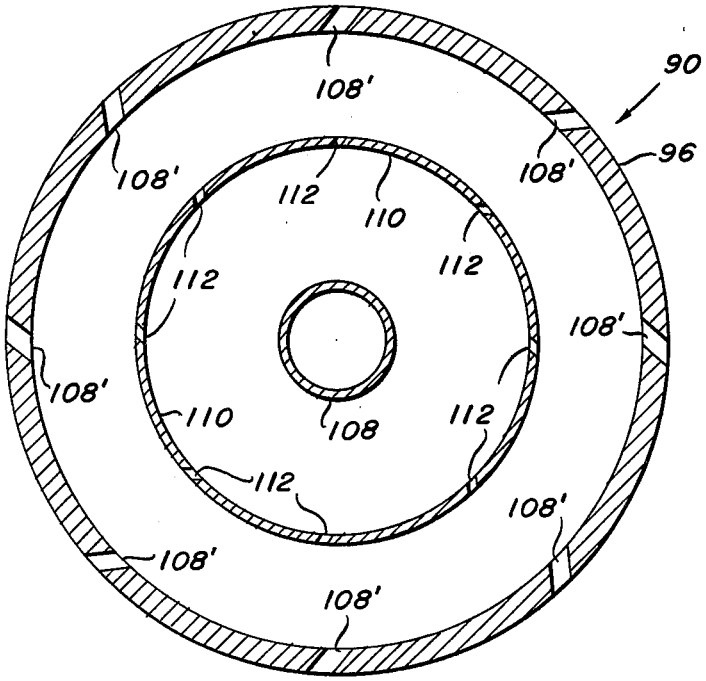
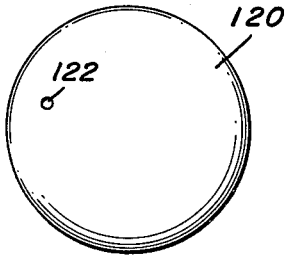
Fig. 19

AERIAL DEVICE

FIELD OF THE INVENTION

This invention relates to an aerial device in the form of a skirted disc and more particularly to an aerial device adapted to be "sailed" in the air in such a manner that rotation is imparted to the device.

BACKGROUND OF THE INVENTION

This invention relates to improvements in disc-like aerial devices which are sailed through the air generally by a snap of the wrist which imparts rotation to the device. In such devices, the rotational force tends to stabilize the disc gyroscopically. The primary purpose of this invention is to increase the "flying time" and height of flight of such aerial devices by providing means for generating greater lift than has heretofore been known in prior art devices.

SUMMARY OF THE INVENTION

In one form of the invention, vanes or impellers or openings of various dimensions are employed in the body of the disc to draw in air from the top side of the device forcing the air downwardly to the underside of the device during rotation thereby tending to force the device upwardly and keeping the device in the air for a longer period of time. In one embodiment, two sets of vanes are employed, one arranged in a first circular pattern, close to and adjacent to the central portion of the disc, and the other or auxiliary set of vanes arranged in a radially spaced second circular pattern. The disc is provided with a skirt around its periphery, preferably of a thickness greater than the body of the disc to provide a flywheel effect when in flight. If desired, air passageways may be formed in the skirt in an angular pattern relative to the inside and outside of the skirt to draw air in through the skirt to the underside of the disc when the latter is rotating in flight. The purpose is to draw a sufficient amount of air into the cavity beneath the disc defined by the skirt to help sustain the disc in flight. The effect achieved is not unlike that of an air cushion or "ground effects" device.

In another embodiment, the vanes are vertically disposed around the central portion or hub of the disc and extend radially outwardly therefrom in a curvilinear fashion. The vanes arranged in this manner tend to provide a centripetal pumping effect to draw air from the upper side of the disc to the underside thereof.

To assist in creating the air cushion or ground effects phenomenon a cylindrical wall, and perhaps plural concentric cylindrical walls, extend downwardly from the underside of the disc to provide additional air cavities for receiving the air pumped downwardly by the vanes and for maintaining an air cushion.

Other embodiments of the aerial device of this invention employ various means for drawing air from either the upper side of the disc or from the outer surfaces of the skirt into the underside of the disc to create an air cushion helping to sustain the device in flight. Further, a hand-held launcher may be provided for launching the device. Additionally, pyrotechnic material may be enlodged in the device to provide additional rotational and lifting thrust as well as an eye-pleasing display.

It is an objective of this invention to provide an aerial device in the form of a disc adapted to be thrown with the snap of the wrist or by a hand-held launcher or other means such that rotation is imparted thereto and which is provided with means that will help to sustain the device in flight for longer periods than has been heretofore known with prior art devices.

It is a further objective of this invention to provide an aerial device which may be easily and inexpensively manufactured.

These and other objects of the invention will become more apparent to those skilled in the art by reference to the following detailed description when viewed in light of the accompanying drawings wherein:

BRIEF DESCRIPTION OF THE DRAWINGS

FIG. 16 is a cross-sectional view of a further modified form of the aerial device of this invention;

FIG. 17 is a view taken on lines 17—17 of FIG. 16;

FIG. 18 is a view taken on lines 18—18 of FIG. 16;

FIG. 19 is a top plan view of another modified form of the aerial device of this invention;

DETAILED DESCRIPTION OF THE INVENTION

Figure 1:
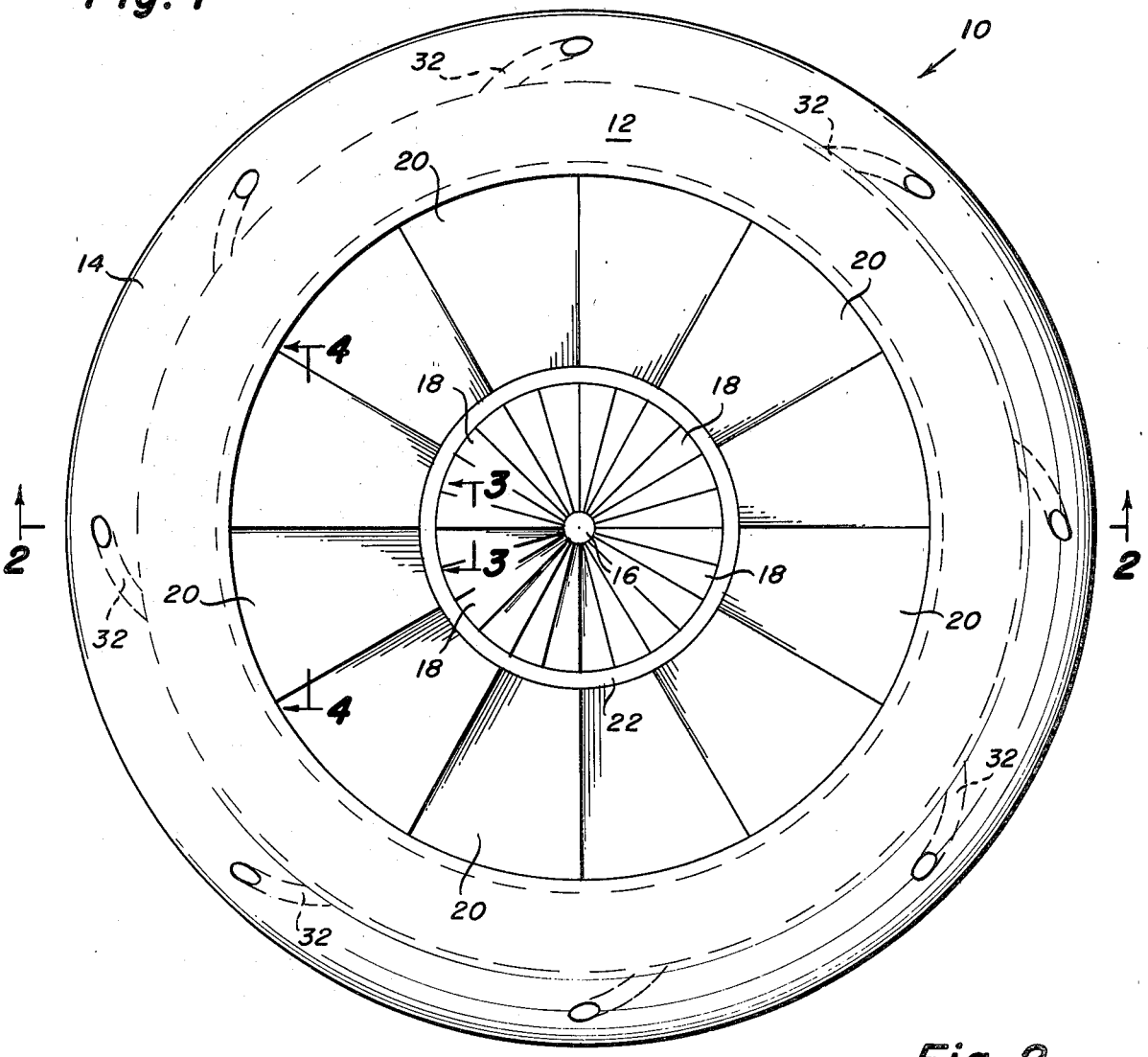
FIG. 1 is a plan view of the aerial device of this invention.
Figure 3:
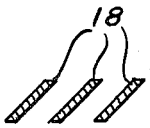
FIG. 3 is a view taken on lines 3—3 of FIG. 1.
Figure 4:
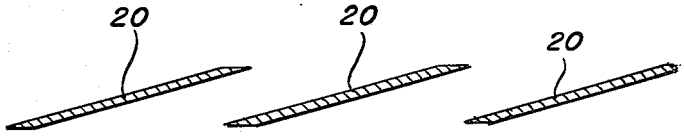
FIG. 4 is a view taken on lines 4—4 of FIG. 1.

Referring now to the drawings wherein like numerals indicate like parts, the aerial device of this invention is indicated in FIG. 1 by the numeral 10 and comprises a disc 12 which is provided with a skirt 14 attached to the periphery of the disc. The skirt 14 may be of a width substantially greater than that of the body portion of the disc 12 to provide a flywheel effect when in flight. The device includes a hub 16 from which emanates a plurality of radially extending vanes 18. The aerial device is designed to be sailed through the air by a snap of the wrist which imparts rotation to the device. Upon rotation, the vanes 18 draw air from the top side of the disc through to the underside thereof to provide an air cushion or "ground effects" device tending to sustain the aerial device in flight for longer periods of time than has heretofore been known in the prior art. The vanes 18 are arranged in a first circular pattern and auxiliary vanes 20 are provided which are arranged in a second circular pattern concentric with the first circular pattern. The pitch of the vanes 16 may be different from that of the vanes 20 as shown in FIGS. 3 and 4. This can be varied as the situation dictates. Further, the vanes shown in the drawings are positioned for clockwise rotation, the direction which would be imparted to the device by a right-handed thrower. It is to be understood that the pitch of the vanes can be reversed to accommodate a left-handed thrower.

Figure 2:
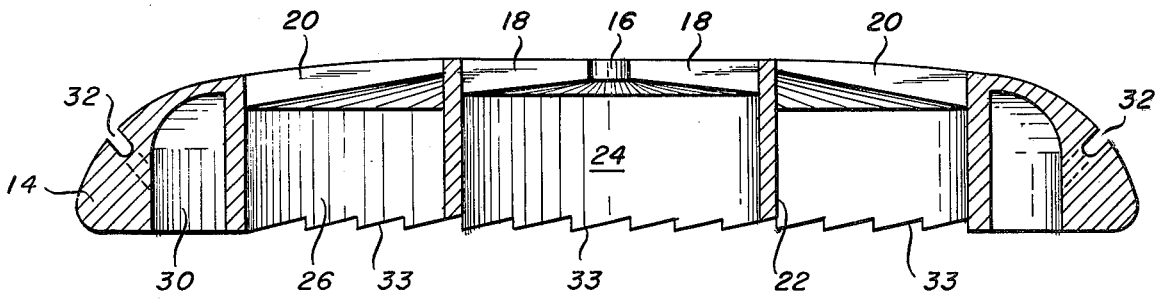
FIG. 2 is a view taken on lines 2—2 of FIG. 1.

As shown in FIG. 2, a first cylindrical wall 22 extends downwardly from the underside of the disc 12 to define an air cavity 24 underlying the vanes 18. A second air cavity 26 underlying vanes 20 is defined by a second downwardly extending cylindrical wall 28 which is concentric and radially spaced from the wall 22. The cavities 24 and 26 tend to maintain the air forced downwardly by the vanes to further enhance the air cushion effect to sustain the device in flight. Still a third chamber 30 is formed between the skirt 14 and the wall 28 and receives air from angularly directed air passageways 32 which extend from the exterior of the skirt to the interior side thereof. Because of the angular orientation of the passageways, air is drawn into the cavity 30 when the disc is rotating in flight. The number of cylindrical walls or skirts may be varied as desired.

To further enhance lift, the bottom edge of the skirt can be provided with what may be referred to as "steps" 33, as seen in FIG. 2, which when oriented according to the direction of rotation act as air foils.

Figure 5:
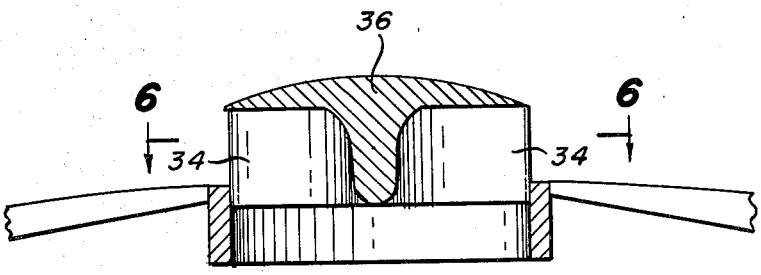
FIG. 5 is a fragmentary cross-sectional view showing a modified form of the aerial device of this invention.
Figure 6:
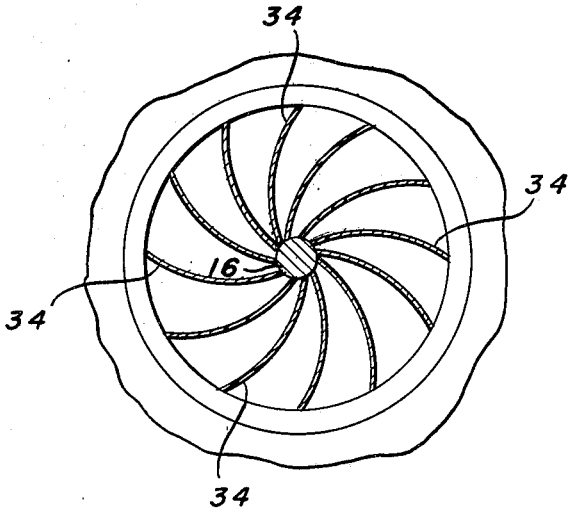
FIG. 6 is a view taken along lines 6—6 of FIG. 5.

A modified form of the vane arrangement of the device of FIG. 1 is shown in FIGS. 5 and 6. Instead of the generally horizontally disposed vanes 18, vertically disposed vanes 34 extend outwardly from the hub 16 in a curvilinear manner. Further, as clearly shown in FIG. 5, the vanes extend above the upper surface of the disc portion of the aerial device. The vanes are covered by a top 36 which is in an aerodynamic shape to reduce air resistance. The vanes in FIGS. 5 and 6 function much like a centripetal pump to draw air radially inwardly and downwardly to the underside of the disc. Otherwise the device is as shown in FIGS. 1 and 2.

Figure 7:
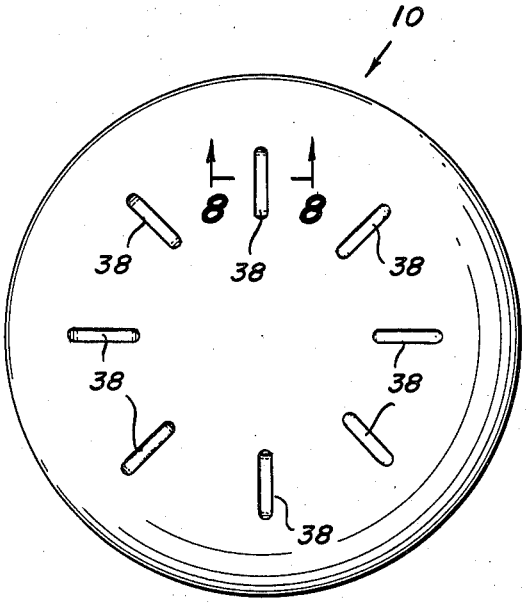
FIG. 7 is a plan view of another modified form of the aerial device of this invention.
Figure 8:
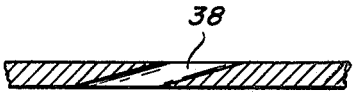
FIG. 8 is a view taken along lines 8—8 of FIG. 7.
Figure 9:
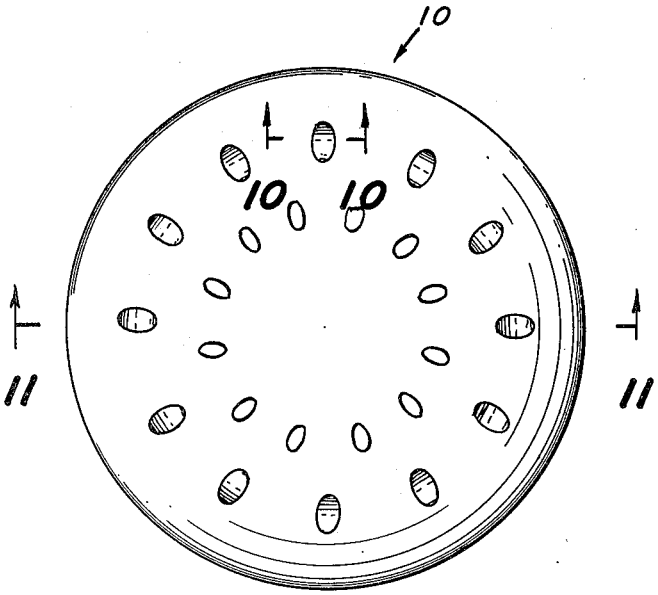
FIG. 9 is a plan view of still another modified form of the aerial device of this invention.
Figure 10:
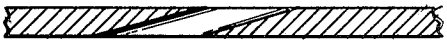
FIG. 10 is a view taken along lines 10—10 of FIG. 9.

A still further embodiment is shown in FIG. 7 and includes substantially rectangular or oblong slots 38 extending radially outwardly from the center of the disc in a circular pattern. Referring to FIG. 8, it can be seen that the slots are angulated with respect to the top and bottom surfaces of the disc such that upon clockwise rotation of the disc, air is collected from the top surface and forced downwardly to the underside of the disc to create an air cushion as described with respect to the embodiment of FIG. 1. The same is essentially true with the embodiment of FIG. 9 except that a plurality of generally circular openings are provided in a pattern concentric with the central axis of the disc. As shown in FIG. 9, two rows of the openings may be provided. A view of the openings, in cross-section, is shown in FIG. 10, and, as with the embodiment of FIG. 8, the openings are angulated inwardly relative to the top and bottom surfaces of the disc to direct air on the top surfaces of the disc to the underside thereof during rotation in flight.

The direction of angulation can be reversed for left-handed throwers. It is to be understood that the openings may be of any suitable size, shape and location as long as they serve the purpose of drawing air from the top side to the underside of the disc.

Figure 11:
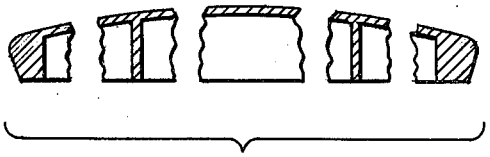
FIG. 11 is a view taken along lines 11—11 of FIG. 9.

FIG. 11 is a cross-sectional view of the disc of FIG. 9; however, it is to be understood that it is also applicable to the embodiment of FIG. 7. FIG. 11 merely shows the provision of a downwardly extending cylindrical wall which forms additional air cavities which serve to enhance the air cushion effect. One or more additional downwardly extending walls may be provided as in the embodiment of FIG. 2. The primary distinction between the embodiments of FIGS. 7 through 11 and 1 and 2 is in the use of apertures or slots as opposed to vanes.

Figure 12:
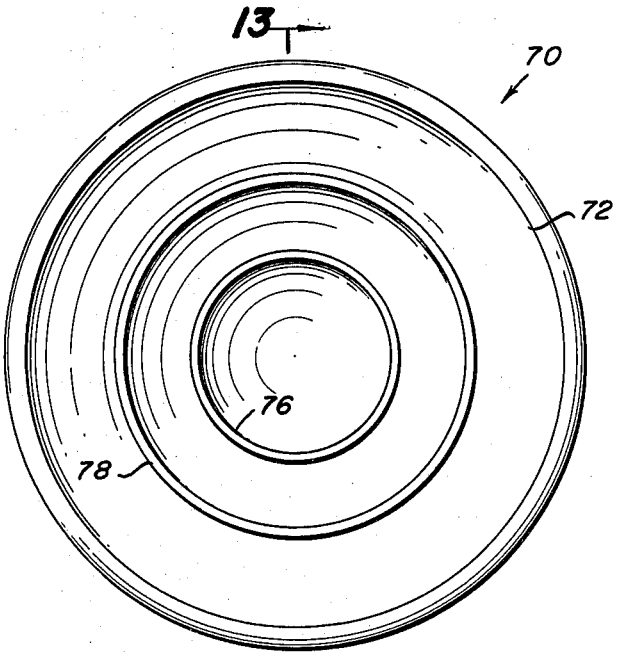
FIG. 12 is a bottom plan view of another modified form of the aerial device of this invention.
Figure 13:
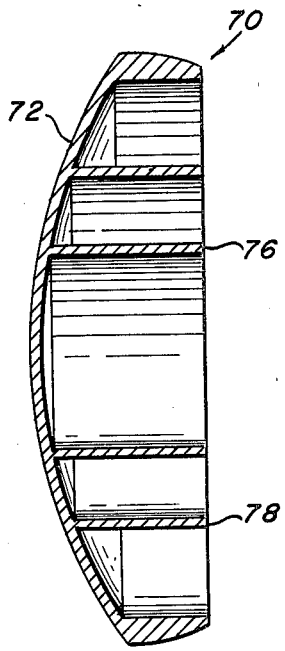
FIG. 13 is a view taken along lines 13—13 of FIG. 12.

A further embodiment of the disc of this invention is shown in FIGS. 12 and 13 and is indicated by the numeral 70. The device includes a disc portion 72 and a skirt 74. The disc portion 72 is provided with concentric downwardly extending cylindrical walls 76 and 78 on the underside thereof to provide air cavities. This embodiment is substantially similar to the embodiment shown in FIG. 2 except that there are no passageways or vanes or the like for introducing air to the underside of the disc. However, the concentric cylindrical walls tend to maintain air under the device to provide some of the desired air cushion effect, and also tend to strengthen the device.

Figure 14:
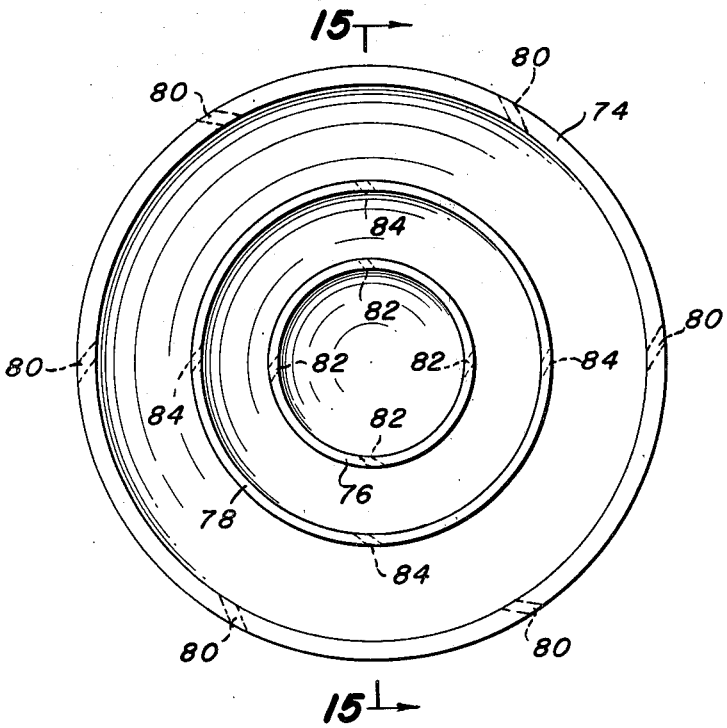
FIG. 14 is a bottom plan view of another modified form of the aerial device of this invention.
Figure 15:
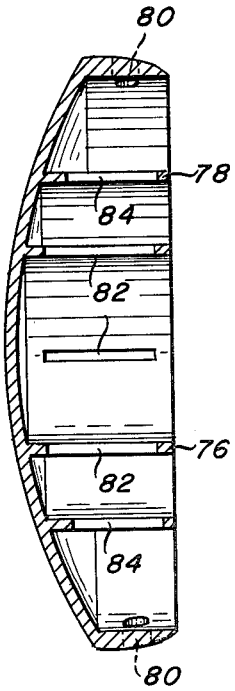
FIG. 15 is a view taken along lines 15—15 of FIG. 14.
Figure 20:
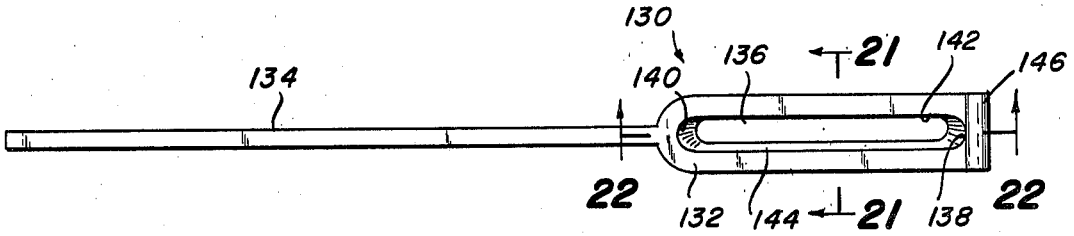
FIG. 20 is a plan view of a launching device for use with the aerial device of this invention.

The embodiments shown in FIGS. 14 and 15 are substantially identical to the embodiments shown in FIGS. 12 and 13 except for the provision of angulated apertures 80 equispaced about the periphery of skirt 74. As in the other embodiments, air is drawn into these passageways upon rotation of the device and is collected on the underside of the disc. In this embodiment, the cylindrical walls 76 and 78 are each provided with a series of openings 82 and 84 which permit communication between, and force air inward into, the various cavities formed by the skirt 74 and the cylindrical walls 76 and 78. The air is actually "pumped" toward the center of the underside of the disc from the outer skirt areas as the disc rotates in flight. It is clear that the number, size, shape and location of the holes may vary.

A further embodiment of the aerial device of this invention is indicated by the numeral 90 in FIG. 16, and includes a disc 92 which is provided with a convex cover 94 which extends out to the periphery of the disc. The disc is provided with a weighted skirt 96 as in the earlier described embodiments. A plurality of vanes 98 as best seen in FIG. 17 extend radially outwardly from the hub 100 in a curvilinear path to the periphery of the disc 92. The top edges of the vanes 98 are joined to the underside of the cover 94 and the bottom edges are joined to the top surface of the disc 92.

The peripheral edge of the cover 94 is spaced from the peripheral edge of the disc 92, and along with the outer edges of the vanes 98 define a plurality of openings 102 around the periphery of the aerial device. A central opening 104 is provided in the disc adjacent to the intersection of the vanes 98 and the hub 100.

Accordingly, as the aerial device 90 is tossed in the air in a manner to impart rotation thereto, air is drawn inwardly through the openings 102 and the centripetal pumping action of the vanes 98 forces the air toward the center of the disc and downwardly through the opening 104 to the cavity 106 defined by a downwardly extending concentric wall 108. The effect is to provide significantly greater lift than has heretofore been known in the prior art.

As best seen in FIG. 18, the skirt 96 is provided with angulated openings 108' at equispaced points about its perimeter. Another cylindrical downwardly extending wall 110 is provided on the underside of the disc 92 and is concentrically placed between the cylindrical wall 108 and the skirt 96. Cylindrical wall 110 is likewise provided with angulated openings 112. Accordingly, as the air is drawn in through the openings 108' it is pumped inwardly through the openings 112 in the cylindrical wall 110 toward the central portion of the disc. As air is forced downwardly and outwardly from the central cavity, it is constantly being replenished by the radially inwardly pumping action.

A still further embodiment is shown in FIG. 19 and includes a disc 120 which is provided with a weighted skirt (not shown) and which can be also provided with downwardly extending cylindrical walls which may have angulated holes (also not shown). Further it is also provided with an eccentrically placed angulated passageway 122 leading from the top side of the disc to the underside thereof. During rotation of the disc air is drawn through this opening to the underside of the disc and because of the eccentric location of the passageway, the disc tends to sail in such a manner that it will have a boomerang effect and will return to the person sailing the device.

In operation, the device of each of the embodiments heretofore described is sailed through the air by grasping the device by the skirt and then snapping the wrist while slinging the device forward. The vanes and apertures assist in forcing air downwardly and/or inwardly (centripetally) through the disc portion of the device to create an uplift tending to sustain the disc in flight for longer periods of time than has heretofore been known in the prior art.

Figure 21:
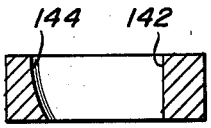
FIG. 21 is a view taken along lines 21—21 of FIG. 20.
Figure 22:
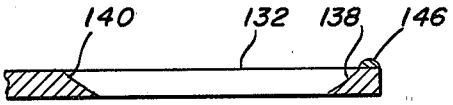
FIG. 22 is a view taken along lines 22—22 of FIG. 20.
Figure 23:
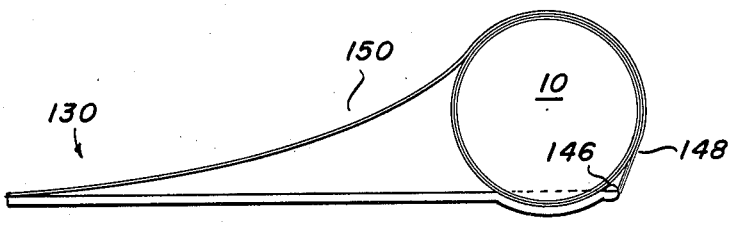
FIG. 23 is a side view in elevation showing the launcher of FIG. 20 with the aerial device of this invention in place.

It may be desirable to launch the device with an implement which will impart greater rotational and translational speed to the device. Such an implement is shown in FIGS. 20 through 23 and includes an elongated thrower 130 having a cradle 132 and an elongated handle 134. The cradle is provided with an elongated aperture 136 which is defined by scooped out front and rear wall portions 138 and 140. The scooped wall portions conform generally to the curvilinear configuration of the aerial device and may be padded. Also, the aperture is defined by the side walls 142 and 144 as seen in FIG. 21. Side wall 144 is curved to conform to the configuration of the top portion of the aerial device in the area of the skirt while the other side is flat to receive the bottom portion of the skirt. A bump or pad 146 of rubber or other high-friction material is positioned on the front of the launcher. Additionally, both side walls may be padded.

To the front end of the implement 130 may be attached a leather or other similar flexible strap 148 which is wrapped around an aerial device 10. The disc is shown in position in the cradle with the strap 148 wound therearound. A cord or string 150 extends from the front end of the device, over the wrapped up disc and toward the free end of the handle 134. The string or cord keeps the disc in place prior to launching. The user grasps the free end of the cord 150 and the handle 134. He then whips the handle forward and releases the cord 150 at the same time such that substantial rotational force is imparted to the disc as it unravels itself from the strap. The disc initially impinges on the friction pad 146 to enhance rotation.

Figure 24:
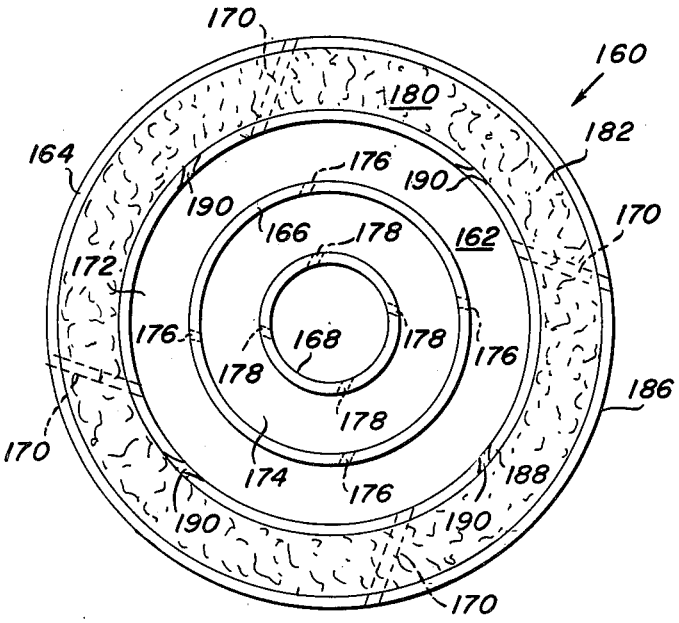
FIG. 24 is a bottom plan view of another modified form of the aerial device of this invention.

A further embodiment of the aerial device of this invention is shown in FIG. 24 and is generally indicated by the numeral 160. The device 160 is substantially similar in construction to the foregoing embodiments and includes a disc 162, a hollow skirt 164 and downwardly extending concentric walls 166 and 168. Air passageways 170 extend inwardly to the underside of the disc from the exterior side surface of the skirt to serve as an air intake in the manner described in previous embodiments. Likewise, the concentric walls 166 and 168 which define air cavities 172 and 174 are provided with angulated inlet passageways 176 and 178 respectively.

The embodiment of FIG. 24 differs from the others primarily by the provision of pyrotechnic material 180 in enclosed annular chamber 182 of the skirt 164. For purposes of description, the skirt may be considered to have an outer wall 186 and an inner wall 188 with the inner wall being provided at a plurality of points with outlets or what may be referred to as rocket nozzles 190. In operation, the pyrotechnic materials are ignited by suitable means (such as a fuse which may be extended through a suitable aperture to communicate with the pyrotechnic material in the hollow space 182) such that when in flight, the material will ignite and will provide further rotational and lifting thrust to the aerial device by means of the gases exiting from the rocket nozzles 190. Additionally, an aesthetically pleasing pyrotechnic display will be provided.

In a general manner, while there has been disclosed effective and efficient embodiments of the invention, it should be well understood that the invention is not limited to such embodiments as there might be changes made in the arrangement, disposition, and form of the parts without departing from the principle of the present invention as comprehended within the scope of the accompanying claims.

I claim:

1. An aerial device designed to sail in the air when thrown in a manner such that rotation is imparted to the device, said device comprising, a disc having a top side and an underside, a downwardly extending skirt attached to the peripheral edge of said disc, air passageways in said skirt permitting air to be drawn into the underside of said disc upon rotation of said disc in flight, and at least one cylindrical wall extending downwardly from the underside of said disc to form an air cavity, said cylindrical wall having openings therein whereby the air is drawn in from said passageways in said skirt due to the rotation of said device and is forced inwardly through said openings toward the center of the underside of said device and then downwardly to enhance lift.

* * * * *